US006120163A

United States Patent [19]

Graber et al.

[11] Patent Number: 6,120,163

[45] Date of Patent: Sep. 19, 2000

[54] PORTABLE STRING HAND LAMP WITH REMOVABLE MOUNT

[75] Inventors: Warren S. Graber, Hoffman Estates; Horacio A. Baggio, Niles, both of Ill.

[73] Assignee: Woodhead Industries Inc., Deerfield, Ill.

[21] Appl. No.: 09/218,800

[22] Filed: Dec. 21, 1998

Related U.S. Application Data

[60] Provisional application No. 60/068,495, Dec. 22, 1997.

[51] Int. Cl.[7] ..... F21V 21/096

[52] U.S. Cl. ..... 362/223; 362/260; 362/398

[58] Field of Search ..... 362/89, 90, 217, 362/222, 223, 224, 260, 397, 398

[56] References Cited

U.S. PATENT DOCUMENTS

| | | | |
|---|---|---|---|
| D. 127,175 | 5/1941 | Mayer | 362/217 |
| 2,888,657 | 5/1959 | Green | 362/217 |
| 4,229,780 | 10/1980 | Nelson | 362/222 |
| 4,881,156 | 11/1989 | Shemitz et al. | 362/260 |
| 5,416,676 | 5/1995 | Carpenter | 362/223 |
| 5,457,614 | 10/1995 | Duty | 362/398 |
| 5,493,482 | 2/1996 | Bowen | 362/260 |
| 5,848,836 | 12/1998 | Graber et al. | 362/223 |

*Primary Examiner*—Alan Cariaso

*Attorney, Agent, or Firm*—James J. Hill; Emrich & Dithmar

[57] ABSTRACT

A portable fluorescent string lamp has a base which includes a threaded nut at each end. An electrical cord extends through each nut. A mounting bracket has a back and two legs spaced to receive the fixture. Each of the legs is releasably secured to the base of the fixture by tightening the coupling nut against it. The back of the bracket is designed to receive a pair of magnetic couplers for removably mounting the fixture to a structure such as a machine.

8 Claims, 1 Drawing Sheet

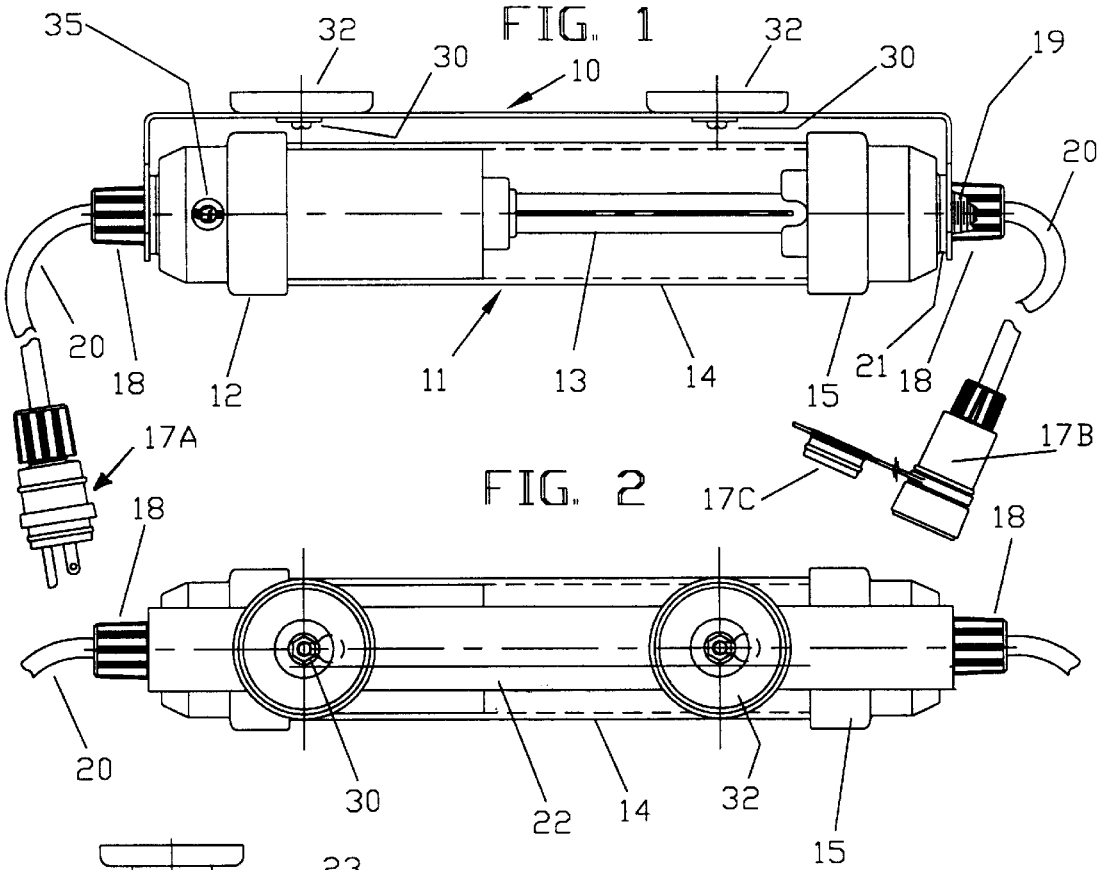
FIG. 1
FIG. 2
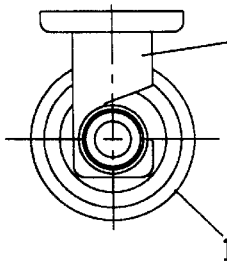
FIG. 3
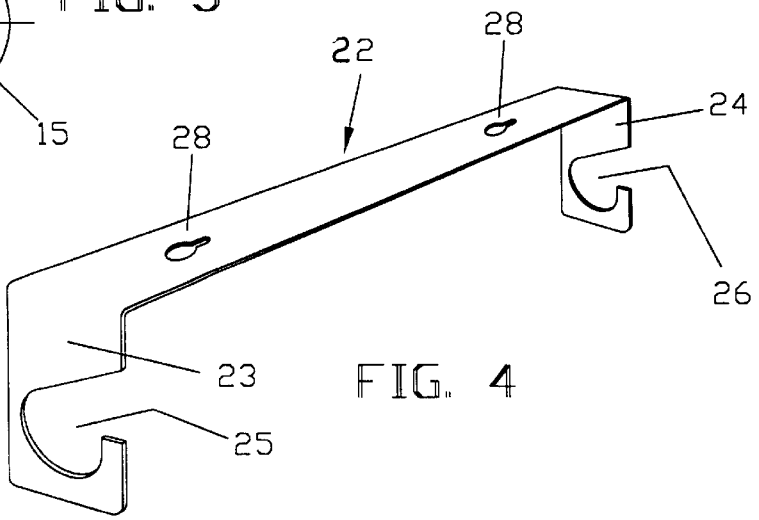
FIG. 4

PORTABLE STRING HAND LAMP WITH REMOVABLE MOUNT

RELATED APPLICATION

This application claims the benefit of the filing date of copending U.S. Provisional Application No. 60/068,495, filed Dec. 22, 1997.

FIELD OF THE INVENTION

The present invention relates to a portable hand lamp, particularly one which can be connected to other similar hand lamps to form a string and wherein each lamp can be removably mounted to structures such as machines for various uses.

SUMMARY OF THE INVENTION

A portable fluorescent lamp fixture has a base which includes, at each end, a cable connector having a threaded nipple and a locking nut. At each end, the cable of a cord set extends through the nipple and is secured by the nut. A mounting bracket has a shallow U-shape including an elongated back and two legs which are spaced at respective ends of the back to receive the fixture.

Each leg of the mounting bracket has a slot which receives the associated cable and each bracket leg is secured to the base of the fixture by tightening the nut against it.

The back of the bracket has two keyhole slots for receiving headed fasteners which may be used to secure magnetic holders for the fixture, or more permanent mounting screws or any other type of securing device, depending on the use application.

Other features and advantages of the present invention will be apparent to persons skilled in the art from the following detailed description of a preferred embodiment accompanied by the accompanying drawing where identical reference numerals will refer to like parts in the various views.

BRIEF DESCRIPTION OF THE DRAWING

FIG. 1 is a side elevational view of the fixture and mounting bracket with a cord shown in foreshortened form at each end;

FIG. 2 is a top view of the apparatus shown in FIG. 1;

FIG. 3 is a left side view of the apparatus shown in FIG. 1 and

FIG. 4 is an upper left side perspective view of the mounting bracket.

DETAILED DESCRIPTION OF A PREFERRED EMBODIMENT

Referring first to FIG. 1, reference numeral 10 generally designates a mounting bracket; and 11 designates a fluorescent hand lamp fixture adapted to be mounted by the bracket 10 to a surface of a structure, such as a machine. The fixture 11 includes a left end cap 12 of molded rubber, a fluorescent lamp 13 within a clear plastic tubular lens 14, and a molded right end cap 15. End caps 12, 15 are fitted onto the respective ends of the tubular lens 14.

Each end cap has a central wire opening defined by a threaded nipple extending out of the rubber covering, such as in FIG. 1 where the nut has been broken away to show nipple 19.

A cord connector includes a threaded nut 18 is threaded on nipple 19. The nipple 19, as mentioned, has a central opening for receiving a cable 20 of an electrical cord set. One cord set has a plug 17A and the other has a receptacle 17B which in the illustrated embodiment has a removable cover 17C. The cord connector conventionally may include a molded grommet (not shown) placed around the cable and received in the central bore of the nipple 19 and secured within the nipple when the nut 18 is tightened, as is known, for providing a mechanically secure and water-resistant connection of the cable with strain relief.

Turning now to the mounting bracket as best seen in FIG. 4, it is formed from a metal strap having a back 22 and first and second legs 23, 24 which are spaced apart to receive the light fixture. Legs 23, 24 have slots 25, 26 respectively which fit over the associated nipple 19 abutting a nut 21 threaded on the nipple. To secure the bracket to the lamp, the nuts 18 are backed off, then the threaded nipples 19 are placed into the slots 25, 26 of legs 23, 24, and the nuts 18 are tightened.

The back 22 of the mounting bracket is provided with two closed "keyhole" slots 28 which are similar. Each slot 28 has a larger round section for receiving the head of a fastener such as a screw or bolt, and a narrow seating section which receives the shank of the fastener, such as designated 30 and seen in FIG. 2. Each fastener 30 secures a magnetic holder 32 to the back 22 of the mounting bracket. Alternatively, the keyhole slots 28 may be used to secure the mounting directly to a structure by using pan head screws or other fasteners without the magnet holders.

As is conventional, each lamp has a conventional ballast circuit, known to those skilled in the art, and may be individually turned on or off by a switch actuated by a push button 35 which is covered by a thinned portion of the molded end cap.

With the present invention, the fixtures can be connected to form a string of lamps and the individual fixtures may be individually and separately mounted as needed.

In addition, when the lights are used to illuminate a work area or a portion of a machine under repair, for example, the nuts 18 may be loosened and the fixture rotated to direct the light to the particular area of interest. Portable fixtures of this nature typically may have a concave reflective surface for focusing the light.

The cord connectors are used not only to mount the fixtures, but, as described, to seal the fixture to the cord and to provide strain resistance for the cord.

With the present invention, the number of fixtures to be used, and the spacing of the fixtures is up to the user. Moreover, individual fixtures can be adjusted by hand without the need for special tools, or an individual unit may be removed from its mounting bracket and used as a conventional hand lamp.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. In combination, an elongated light fixture including a light lens and first and second end caps;

a lamp in said housing;

at least one electrical cord received in said first end cap;

a threaded lock nut releasably securing said electrical cord to said first end cap;

a mounting bracket including an elongated base having a length approximately equal to the length of said housing, and first and second legs, spaced apart and adapted to receive said end caps respectively, at least one of said legs defining a slot sized to receive an associated end cap of said fixture and adapted to be secured to said housing by tightening said lock nut thereagainst; and at least one mounting element constructed and arranged to releasably secure said base of said mounting bracket to a structure.

2. The apparatus of claim 1 wherein said light is a fluorescent lamp and wherein said lens is tubular in shape and surrounding said fluorescent lamp.

3. The apparatus of claim 2 further including a reflector within said lens for focusing light from said lamp, and characterized in that said lock nut may be loosened, permitting said fixture to be rotated about an axis parallel to said base.

4. The apparatus of claim 1 further comprising a second cord received in a second lock nut associated with said second end cap, said second leg of said bracket being releasably coupled to said second end cap by means of said second lock nut.

5. The apparatus of claim 4 wherein said first cord includes an electrical receptacle and said second cord includes an electrical plug, whereby said fixture may be used as one light source in a string of similar fixtures.

6. The apparatus of claim 5 wherein each of said end caps includes a threaded nipple, said first and second cords extending through an associated threaded nipple, and wherein said cords and said first and second legs of said bracket are secured respectively to said first and second end caps by tightening of said first and second lock nuts respectively.

7. The apparatus of claim 1 wherein said base of said mounting bracket defines first and second keyhole slots spaced apart for receiving said mounting means, said mounting means comprising magnetic mounting means whereby said fixture may be mounted to a metal surface.

8. The apparatus of claim 7 wherein each of said legs of said bracket includes a slot having an opening for receiving said first and second end caps respectively when said first and second lock nuts are unloosened, and wherein said light fixture may be secured to said bracket after said end caps are received in said slots by tightening said lock nuts.

* * * * *